US008966934B2

(12) United States Patent
Christensen

(10) Patent No.: US 8,966,934 B2
(45) Date of Patent: Mar. 3, 2015

(54) REFRIGERATION SYSTEM

(75) Inventor: Kim G. Christensen, Aarhus V (DK)

(73) Assignee: Hill Phoenix, Inc., Conyers, GA (US)

( * ) Notice: Subject to any disclaimer, the term of this patent is extended or adjusted under 35 U.S.C. 154(b) by 0 days.

(21) Appl. No.: 13/494,781

(22) Filed: Jun. 12, 2012

(65) Prior Publication Data

US 2013/0145791 A1 Jun. 13, 2013

(30) Foreign Application Priority Data

Jun. 16, 2011 (DK) ..... 2011 70306

(51) Int. Cl.

| | |
|---|---|
| ***F25B 1/00*** | (2006.01) |
| ***F25B 1/10*** | (2006.01) |
| ***F25B 9/00*** | (2006.01) |
| *F25B 5/02* | (2006.01) |

(52) U.S. Cl.

CPC ... *F25B 1/00* (2013.01); *F25B 1/10* (2013.01); *F25B 9/008* (2013.01); *F25B 5/02* (2013.01); *F25B 2309/061* (2013.01); *F25B 2400/053* (2013.01); *F25B 2400/13* (2013.01); *F25B 2400/23* (2013.01)

USPC ..... 62/498; 62/512; 62/513

(58) Field of Classification Search

CPC ..... F25B 2400/053; F25B 2309/061; F25B 2400/23; F25B 1/00; F25B 2400/13; F25B 9/008

USPC ..... 62/498, 196.2, 197, 430, 488, 502, 509, 62/335, 117, 510, 513, 512, 210, 224, 174, 62/473, 503, 113

See application file for complete search history.

(56) References Cited

U.S. PATENT DOCUMENTS

| | | | |
|---|---|---|---|
| 4,551,983 | A | 11/1985 | Atsumi et al. |
| 6,170,272 | B1 | 1/2001 | Backman |
| 7,065,979 | B2 | 6/2006 | Arshansky et al. |
| 7,644,593 | B2 | 1/2010 | Duraisamy |
| 7,878,023 | B2 | 2/2011 | Heinbokel |

(Continued)

FOREIGN PATENT DOCUMENTS

| | | | |
|---|---|---|---|
| CA | 2 724 255 | C | 9/2011 |
| CA | 2 735 347 | C | 10/2011 |

(Continued)

OTHER PUBLICATIONS

International Search Report and Written Opinion for International Application No. PCT/US2012/065522, mail date Feb. 8, 2013, 10 pages.

(Continued)

*Primary Examiner* — Cheryl J Tyler
*Assistant Examiner* — Ana Vazquez
(74) *Attorney, Agent, or Firm* — Foley & Lardner LLP

(57) ABSTRACT

A refrigeration system using CO2 as a refrigerant includes a receiver having a liquid outlet connected to expansion valves, which are connected to evaporators, which are connected to the suction side of the compressor. The receiver includes a second gas outlet connected to a second pressure reduction device, to reduce the energy consumption in CO2 cooling systems and to protect the compressors against liquid CO2 by heating the suction gas. The second pressure reduction device is connected by tubing to a first heat exchanging device, which is integrated in the receiver, so that gas that is evaporated in the top of a receiver can be used for cooling the liquid part of the same receiver.

7 Claims, 5 Drawing Sheets

(56) References Cited

U.S. PATENT DOCUMENTS

| | | | | |
|---|---|---|---|---|
| 7,913,506 | B2 | 3/2011 | Bittner et al. | |
| 8,113,008 | B2 | 2/2012 | Heinbokel et al. | |
| 2009/0019878 | A1* | 1/2009 | Gupte | 62/335 |
| 2009/0025404 | A1 | 1/2009 | Allen | |
| 2009/0120108 | A1 | 5/2009 | Heinbokel et al. | |
| 2009/0260389 | A1 | 10/2009 | Dube | |
| 2009/0272128 | A1 | 11/2009 | Ali | |
| 2010/0023171 | A1 | 1/2010 | Bittner et al. | |
| 2010/0031697 | A1 | 2/2010 | Hinde et al. | |
| 2010/0199707 | A1 | 8/2010 | Pearson | |
| 2010/0205984 | A1 | 8/2010 | Gu et al. | |
| 2011/0146313 | A1 | 6/2011 | Finckh et al. | |
| 2011/0154840 | A1 | 6/2011 | Mihara et al. | |
| 2011/0314843 | A1 | 12/2011 | Heinbokel et al. | |
| 2011/0314846 | A1 | 12/2011 | Heinbokel et al. | |
| 2012/0007319 | A1 | 1/2012 | Miura et al. | |
| 2012/0011866 | A1 | 1/2012 | Scarcella et al. | |
| 2012/0022706 | A1 | 1/2012 | Fan et al. | |
| 2012/0036854 | A1 | 2/2012 | Vaisman et al. | |
| 2012/0055182 | A1 | 3/2012 | Dub | |

FOREIGN PATENT DOCUMENTS

| | | | |
|---|---|---|---|
| EP | 1 789 732 | B1 | 5/2007 |
| EP | 1 795 835 | | 6/2007 |
| JP | S51 74849 | | 6/1976 |
| JP | S60 253763 | | 12/1985 |
| JP | H09 196480 | | 7/1997 |
| WO | WO-2006/091190 | | 8/2006 |
| WO | WO 2006/091190 | A1 | 8/2006 |
| WO | WO 2011/049767 | | 4/2011 |

OTHER PUBLICATIONS

Official Action for Danish Application No. PA 2011 70306, dated Jan. 19, 2012, 3 pages.

Official Action for Danish Application No. PA 2011 70306, dated Jan. 25, 2012, 3 pages.

Danish Search Report for Application No. PA 2011 70306, date of completion Jan. 16, 2012, 1 page.

International Search Report and Written Opinion for International Application No. PCT/IB2012/001995, dated May 23, 2013, 9 pages.

* cited by examiner

REFRIGERATION SYSTEM

CROSS REFERENCE TO RELATED APPLICATIONS

The present application claims the benefit of priority to Denmark Patent Application No. PA 2011 70306 titled "Refrigeration System" and filed on Jun. 16, 2011, the complete disclosure of which is hereby incorporated by reference for all purposes.

FIELD

The present invention relates to a refrigeration system primarily using $CO_2$ as refrigerant, which refrigeration system comprises at least one first compressor, from which compressor a pressure outlet tube is connected to at least one heat rejecting heat exchanger, which heat rejecting heat exchanger is connected to at least one first pressure reduction device and by tubing further connected to at least one receiver, which receiver comprises at least one first liquid outlet, which outlet is connected by tubing to one or more first pressure reduction devices, such as expansion valves, which expansion valves are connected to at least one first group of evaporators, which evaporators are connected by suction tubing to the suction side of the compressor, which receiver comprises at least one second outlet, which second outlet takes gas and is connected by tubing to a second pressure reduction device.

BACKGROUND

EP 1789732 discloses a CO2 refrigeration circuit for circulating a refrigerant in a predetermined flow direction, comprising in flow direction a heat-rejecting heat exchanging device, a receiver having a liquid portion and a flash gas portion, and subsequent to the receiver a medium temperature loop and a low temperature loop, wherein the medium and low temperature loops each comprise in flow direction an expansion device, an evaporator and a compressor, the refrigeration circuit further comprising a liquid line connecting the liquid portion of the receiver with at least one of the medium and low temperature loops and having an internal heat exchanging device, and a flash gas line connecting the flash gas portion of the receiver via the internal heat exchanging device with the inlet of the low temperature compressor, wherein the internal heat exchanging device transfers in use heat from the liquid flowing through the liquid line to the flash gas flowing through the flash gas line.

It is an object of the invention to reduce the energy consumption in $CO_2$ cooling systems, a further object is to protect one or more compressors against liquid $CO_2$ in the compressor inlet by heating the suction gas.

SUMMARY

The second pressure reduction device is connected by tubing to a first heat exchanging device, which first heat exchanging device is integrated in the receiver, either in liquid part, gas part or in both, in which first heat exchanging device the refrigerant is heated, which heated refrigerant is combined into the suction tubing.

Subsequent to the first pressure reduction device, gas and liquid is created and enters the receiver. Formation of gas in the receiver cannot be avoided, but the flash gas portion has to be removed to keep pressure low (30-45 bar) inside the receiver. Because the gas, from the top of the receiver is sent to a second pressure reduction device, the temperature is decreased in the gas and some liquid is created. The gas is sent into a heat exchanging device from which heat exchanging device the gas is sent to the suction side of the compressor group. By recirculating the gas portion after the second pressure reduction device back through the receiver, the temperature in the liquid part of a receiver will decrease and also some gas inside the receiver will condense. The efficiency of the whole cooling system is thereby improved. Not only is the flash gas of refrigerant in a receiver reduced, but the lower temperature in the liquid will also lead to higher efficiency in the evaporators that are supplied afterwards with liquid refrigerant through pressure reduction means. Because the flash gas is sent through the heat exchanging device in the receiver, the flash gas is heated inside the heat exchanging device and the flash gas is mixed with a suction gas increasing the temperature of the suction gas back to the compressor. In this way liquid refrigerant is avoided from being sent towards the suction side of the compressor.

The second pressure reduction device can be connected by tubing and combined with the suction gas into a combined line, which line is connected to the inlet to the heat exchanging device, which heat exchanging device is connected by tubing to the suction side of the compressor. Wherby heating of the suction gas is achieved, and the refrigerant in the receiver is further cooled.

The suction gas from the suction tubing is connected by tubing to a second heat exchanging device, which second heat exchanging device is integrated into the receiver, which second heat exchanging device is connected by tubing to the suction side of the compressor. Whereby the suction gas, coming from evaporators having a relatively low temperature, is heated in the heat exchanging device in the receiver. Further whereby the temperature inside the receiver is reduced, in a way where some condensation takes place so that the amount of gas inside the receiver is reduced. The suction gas that is sent through the heat exchanging device is in the same way being heated, and the temperature of the suction gas is then sufficiently high that liquid particles in the gas are avoided in the suction line towards the compressor. The suction gas leaving the evaporators can have a temperature only a few degrees below zero, and heating the gas up to approximately plus 10 degrees is sufficient to avoid any liquid particles in the gas.

The refrigeration system can comprise a second group of evaporators, which evaporators are connected by tubing to the receiver outlet towards pressure reduction devices such as expansion valves, which second evaporators are connected by tubing to the suction side of one or more second compressors, which second compressors have a pressure outlet, which pressure outlet is connected by tubing to the suction line of the first compressors.

The refrigeration system comprises a second group of evaporators, which evaporators are connected by tubing to the receiver outlet towards pressure reduction devices such as expansion valves, which second evaporators are connected by tubing to a third heat exchanging device, which third heat exchanging device is integrated in the receiver, from which third heat exchanging device tubing connects to the suction side of one or more second compressors, which second compressors have a pressure outlet, which pressure outlet is connected by tubing to the suction line of the first compressors. Whereby suction gas from a freezer group which is relatively cold and at least several degrees below zero is sent through a heat exchanging device inside the receiver, in that way the gas is heated, but the content of the receiver is being cooled down. Therefore, further condensation may take place inside the receiver and at least the outlet temperature of liquid refrigerant for the supply of expansion valves has a reduced temperature. At the same time, the suction gas which is sucked towards a suction compressor has an increased temperature so that all refrigerant is evaporated when it reaches the compressor.

The refrigeration system can comprise a second group of evaporators, which evaporators are connected by tubing to the receiver outlet towards pressure reduction devices such as expansion valves, which second evaporators are connected by tubing to a third heat exchanging device, which third heat exchanging device is integrated in the receiver, from which third heat exchanging device tubing connects to the suction side of one or more second compressors, which second compressors have a pressure outlet, which pressure outlet is connected by tubing to a mixing point, at which mixing point the gas is mixed with the line coming from the second pressure reduction device, which mixed gas is led by tubing into a heat exchanging device, which heat exchanging device is connected by tubing to a second mixing point, by which mixing point the gas is mixed with the suction gas in a line from the first evaporators, which second mixing point is connected to the suction side of the compressor or compressor group.

The refrigeration system can comprise a second group of evaporators, which evaporators are connected by tubing to the receiver outlet towards pressure reduction devices such as expansion valves, which second evaporators are connected by tubing to a third heat exchanging device, which third heat exchanging device is integrated in the receiver, from which third heat exchanging device tubing connects to the suction side of one or more second compressors, which second compressors have a pressure outlet, which pressure outlet is by tubing connected to a mixing point, at which mixing point the gas is mixed with the suction gas in line, which mixed gas is connected by tubing to a second mixing point, at which second mixing point the gas is mixed with the gas in line coming from the second pressure reduction device, which mixed gas is led by tubing into a heat exchanging device, which heat exchanging device is connected by tubing to the suction side of the compressor or compressor group.

DETAILED DESCRIPTION

Figure 1:
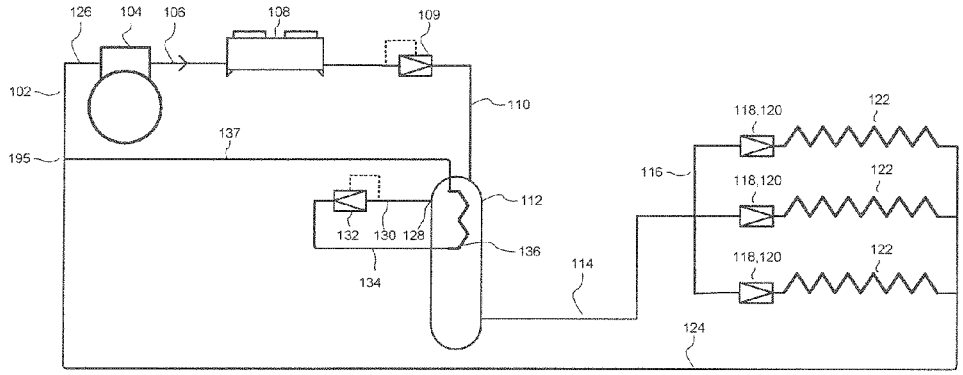
FIG. 1 shows a cooling system in a first embodiment for the invention.

FIG. 1 shows a first exemplary embodiment for the invention. At FIG. 1 is indicated a cooling system 102 which comprises one or more compressors 104, which compressor 104 has a pressure outlet line 106 connected to a heat rejecting heat exchanging device 108. The heat rejecting heat exchanger 108 is connected through a high pressure control valve 109 through a line 110 into a receiver 112. This receiver has an outlet 114 connected to a connection line 116 which is connected to pressure reduction means 118, shown primarily as expansion valves 120, into evaporators 122. From the evaporators 122 is a line 124 connected to the compressor suction side 126. The receiver 112 comprises further a gas outlet 128 connected over line 130 into a pressure reduction valve 132 and from here through a line 134 into a heat exchanging device 136 placed inside the receiver 112. From the heat exchanging device 136 there is a connection line 137 which is combined with the suction line 124.

In operation the system will function as a cooling system operating primarily with carbon dioxide as refrigerant. One difference to traditional cooling systems is that the pressure in the receiver is kept low by removing gas from the receiver and the gas from the receiver 112 is used for cooling the liquid and condensing the gas in the receiver. That is achieved by letting the flash gas flow through the pressure reduction valve 132 and then into the heat exchanging device 136. Here is the relatively cool gas used for reducing the temperature in the refrigerant inside the receiver 112. Whereby the gas inside the heat exchanging device 136 is heated and this heated gas is then transported through the line 137 combined with a suction gas, where the temperature of the suction gas further increased. By using the gas inside the receiver for further cooling of the liquid part of the receiver, the efficiency of the cooling system is increased.

Figure 2:
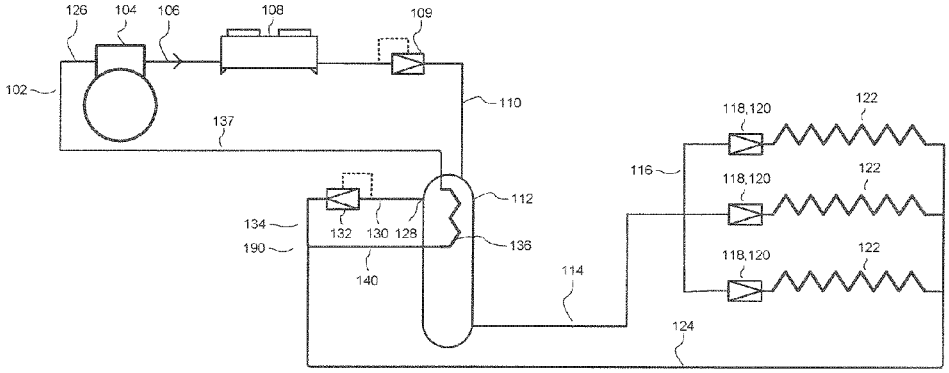
FIG. 2 show an alternative embodiment to the system disclosed at the FIG. 1.

FIG. 2 discloses an alternative embodiment to FIG. 1. FIG. 1*a* illustrates a cooling system 102 which comprises one or more compressors 104, which compressor 104 has a pressure outlet line 106 connected to a heat rejecting heat exchanger 108. The heat rejecting heat exchanger 108 is connected through a high pressure control valve 109 through a line 110 into a receiver 112. This receiver has an outlet 114 connected to a connection line 116 which is connected to pressure reduction means 118, shown primarily as expansion valves 120, into evaporators 122. From the evaporators 122 is a line 124 connected to the compressor suction side 126. The receiver 112 comprises further a gas outlet 128 connected over line 130 into a pressure reduction valve 132 and from here through a line 134 into a connection point where the suction line 124 and the line 134 are combined into line 140, which line 140 is connected to the heat exchanging device 136 placed inside the receiver 112. The heat exchanging device has an outlet connected by line 137 into the compressor suction line 126.

Figure 3:
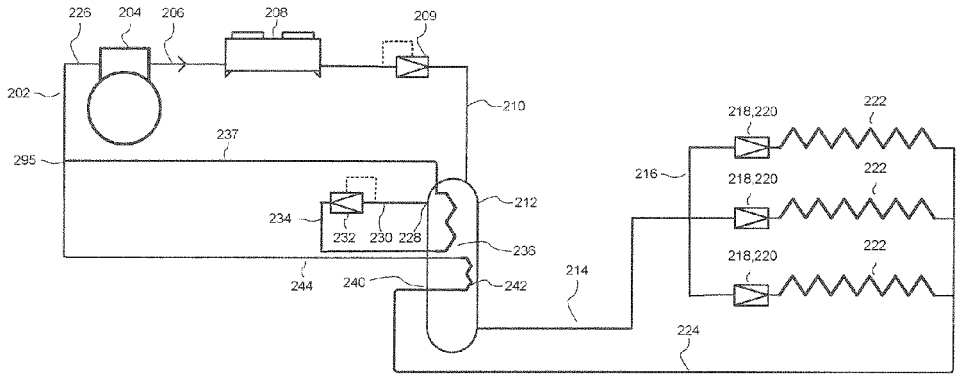
FIG. 3 shows an alternative embodiment for the invention.

FIG. 3 shows another alternative embodiment to what is shown at FIG. 1. FIG. 3 shows a cooling system 202 which cooling system comprises a compressor or a compressor group 204 which has a pressure outlet 206. This pressure outlet 206 is connected to a heat rejecting heat exchanger 208 and the heat rejecting heat exchanger 208 is further connected to a high pressure control valve 209 from where a line 210 leads to a receiver 212. From this receiver, an outlet 214 is sending liquid refrigerant towards expansion means, such as expansion valves 218, 220, and from where the expanded refrigerant is sent through evaporators 222. The evaporators 222 are connected into a suction line 224. The line 224 is connected to an inlet 240 into the receiver 212 and further into a heat exchanging device 242 placed in the top of the receiver 212. An outlet 244 from the receiver 212 is connected to the suction line 226 towards the compressor group 204.

The suction gas that is leaving the evaporators 222 is relatively cool as it is flowing through the line 224 and into the heat exchanging device 242. Thereby the suction gas is heated in the heat exchanging device, and the gas inside the receiver 212 is cooled down to a lower temperature which is intended to lead to condensation in the gas so that further liquid refrigerant is generated. The heated suction gas that is leaving through the outlet 244 and sent to the compressor through the suction line 226 is thereby increased in temperature so that liquid particles can be avoided in the part of the gas that is sucked into the compressor, whereby further security is achieved against liquid hammer in a piston compressor and the total effectivity of the system is increased.

Figure 4:
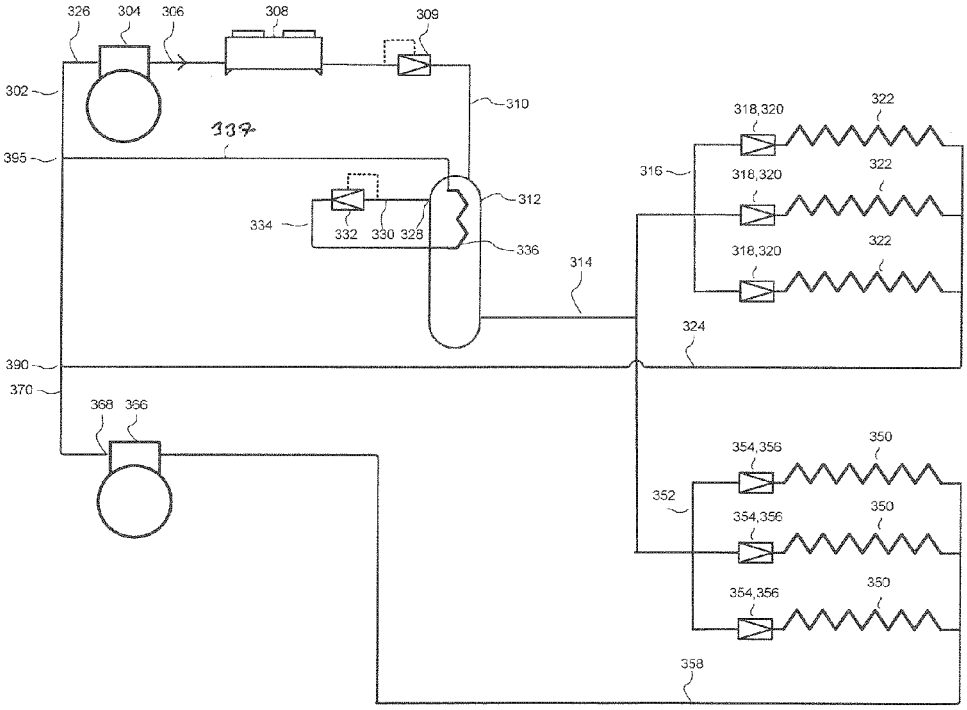
FIG. 4 shows a third embodiment for the invention.

FIG. 4 shows a cooling system 302 comprises a compressor group 304 which is through a pressure line 306 connected to a heat rejecting heat exchanger 308 according to a second exemplary embodiment. From this heat rejecting heat exchanger 308, the refrigerant flows through a high pressure control valve 309 into a line 310 into a receiver 312. From this receiver a liquid outlet 314 is connected into pressure reduction means, shown as expansion valves 318, 320, into evaporators 322 from where the refrigerant is sent through a suction line 324 to the compressor suction side 326. The liquid outlet 314 from the receiver 312 is further connected to low temperature evaporators through pressure reduction means, shown as expansion valves 354, 356, into the low temperature evaporators 350, which evaporators 350 are connected by tubing 352 to the receiver outlet 314 towards pressure reduction devices 354 such as expansion valves 356, which second evaporators 350 are connected by tubing 358 to the suction side 364 of one or more second compressors 366, which second compressors have a pressure outlet 368, which pressure outlet 368 is connected by tubing 370 to the suction line 324 to the first compressors 304.

Figure 5:
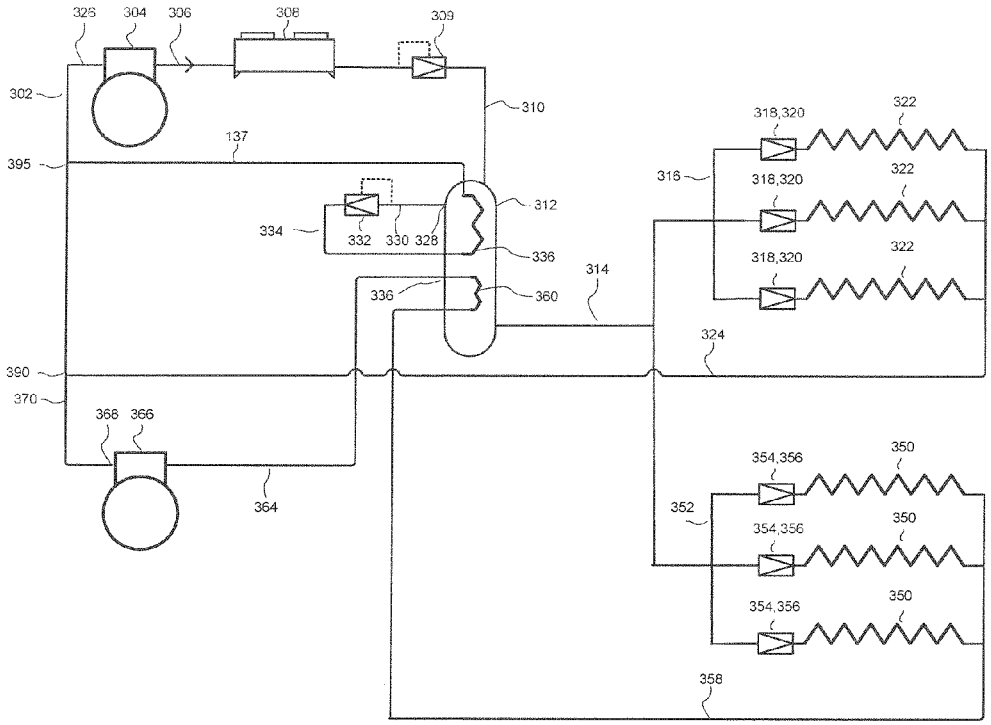
FIG. 5 shows an alternative embodiment for the invention disclosed at FIG. 4.

FIG. 5 shows a third exemplary embodiment for the invention. A cooling system 302 comprises a compressor group 304 which is connected through a pressure line 306 to a heat rejecting heat exchanger 308. From this heat rejecting heat exchanger 308, the refrigerant flows through a high pressure control valve 309 into a line 310 into a receiver 312. From this receiver 312, a liquid outlet 314 is connected into pressure reduction means, shown as expansion valves 318, 320, into evaporators 322 from where the refrigerant is sent through a suction line 324 to the compressor suction side 326. The liquid outlet 314 from the receiver 312 is further connected to low temperature evaporators through pressure reduction means, shown as expansion valves 354, 356, into the low temperature evaporators 350. The outlet from the evaporators 350 is sent through a line 358 through a heat exchanging device 360 integrated in the receiver 312. The outlet from the heat exchanging device 362 is connected to a suction line 364 of a further low temperature compressor or compressor group 366 which has an outlet 368 which is connected by line 370 to the suction line 326, whereby the relatively cool suction gas from the evaporators used in freezers is used for a temperature reduction in the receiver 312. Thereby the liquid content and also the gas content of the receiver is cooled to a lower temperature which may also lead to condensation of the gas in the receiver 312. At the same time, it leads to heating the suction inside the heat exchanging device 360 to a temperature level where the entire refrigerant is evaporated, before the refrigerant reaches the low temperature compressor 366.

Figure 6:
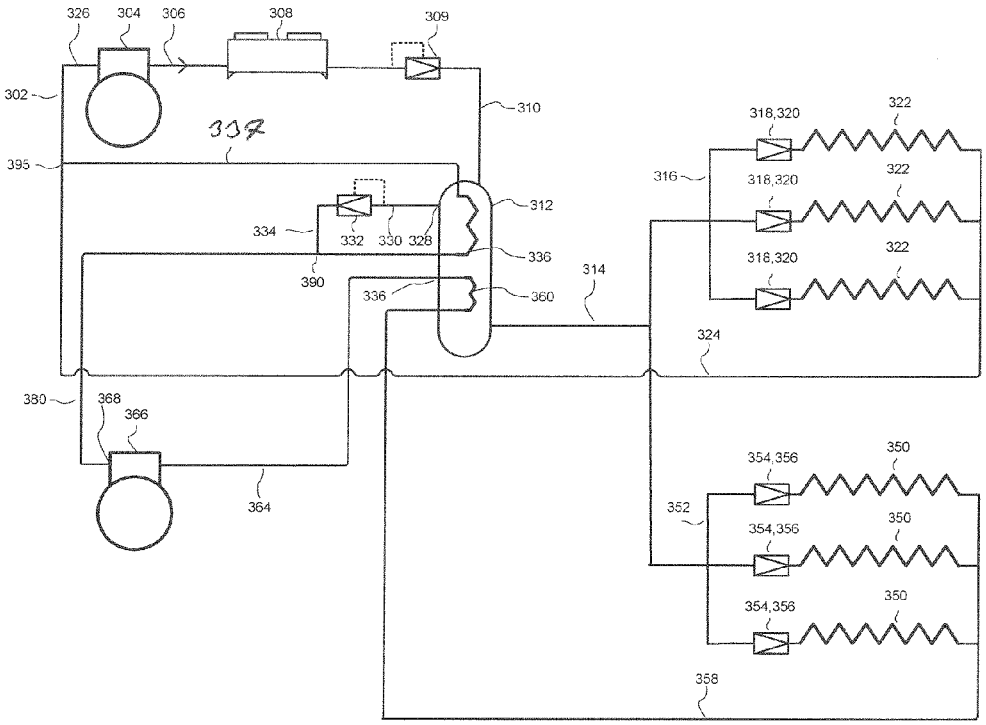
FIG. 6 shows a further alternative embodiment for the invention disclosed at FIG. 4.

FIG. 6 shows a cooling system 302 which comprises a compressor group 304 which is connected through a pressure line 306 to a heat rejecting heat exchanger 308. From this heat rejecting heat exchanger 308, the refrigerant flows through a high pressure control valve 309 into a line 310 into a receiver 312. From this receiver 312, a liquid outlet 314 is connected into pressure reduction means, shown as expansion valves 318, 320, into evaporators 322 from where the refrigerant is sent through a suction line 324 to the compressor suction side 326. The liquid outlet 314 from the receiver 312 is further connected to low temperature evaporators through pressure reduction means, shown as expansion valves 354, 356, into the low temperature evaporators 350, which evaporators 350 are connected by tubing 352 to the receiver outlet 314 towards pressure reduction devices 354 such as expansion valves 356, which second evaporators 350 are connected by tubing 358 to a third heat exchanging device 360, which third heat exchanging device 360 is integrated in the receiver 312, from which third heat exchanging device 360 connects by tubing 362 to the suction side 364 of one or more second compressors 366, which second compressors 366 have a pressure outlet 368, which pressure outlet 368 is connected by tubing 380 to a mixing point 390, at which mixing point the gas is mixed with the gas in line 334 coming from the second pressure reduction device 332, which mixed gas is led by tubing into a heat exchanging device 336, which heat exchanging device 336 is connected by tubing 337 to a second mixing point 395, by which mixing point 395 the gas is mixed with the suction gas in a line 324 from the first evaporators 322, which second mixing point 395 is connected to the suction side 326 of the compressor or compressor group 304.

Figure 7:
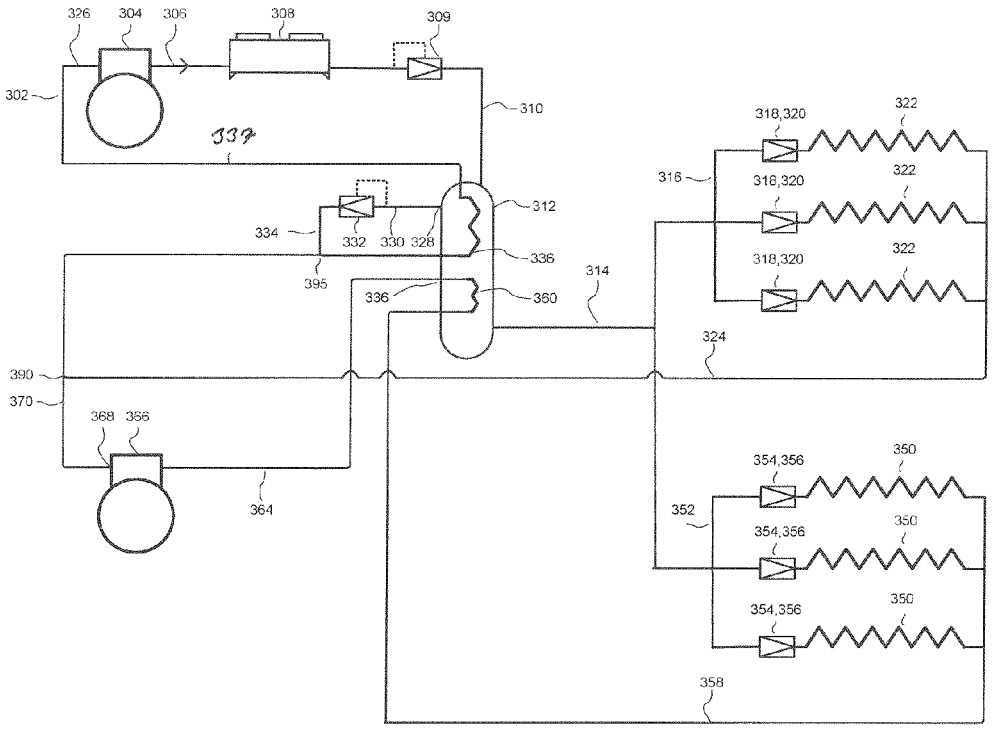
FIG. 7 shows a further alternative embodiment for the invention disclosed at FIG. 4.

FIG. 7 shows a cooling system 302, which comprises a compressor group 304 which is through a pressure line 306 connected to a heat rejecting heat exchanger 308. From this heat rejecting heat exchanger 308, the refrigerant flows through a high pressure control valve 309 into a line 310 into a receiver 312. From this receiver 312 a liquid outlet 314 is connected into pressure reduction means, shown as expansion valves 318, 320, into evaporators 322 from where the refrigerant is sent through a suction line 324 to the compressor suction side 326. The liquid outlet 314 from the receiver 312 is further connected to low temperature evaporators through pressure reduction means, shown as expansion valves 354, 356, into the low temperature evaporators 350, which evaporators 350 are connected by tubing 352 to the receiver outlet 314 towards pressure reduction devices 354 such as expansion valves 356, which second evaporators 350 are connected by tubing 358 to a third heat exchanging device 360, which third heat exchanging device 360 is integrated in the receiver 312, from which third heat exchanging device 360 connects by tubing 364 to the suction side of one or more second compressors 366, which second compressors 366 have a pressure outlet 368, which pressure outlet 368 is connected by tubing 370 to a mixing point 390, at which mixing point 390 the gas is mixed with the suction gas in line 324, which mixed gas is connected by tubing to a second mixing point 395, at which second mixing point 395 the gas is mixed with the gas in line 334 coming from the second pressure reduction device 332, which mixed gas is led by tubing into a heat exchanging device 336, which heat exchanging device 336 is connected by tubing 337 to the suction side 326 of the compressor or compressor group 304.

In a preferred embodiment, all the different heat exchanging devices described in FIG. 1-7 can be combined into a common system where all or some heat exchanging devices are placed inside the same receiver. All heat exchanging devices described in FIG. 1-7 are configured as a volume and a surface capable of holding a refrigerant volume and exchanging heat between refrigerant inside the heat exchanging device and the refrigerant in the receiver. The heat exchanging device could be designed as a vessel, coil or a plate construction. Position of exchangers can vary from gas part of receiver to liquid part of the receiver. Drawings with more than one heat exchanging device showing the position of these heat exchanging devices can be placed independently from each other.

Also, many different types of heat exchanger devices can be used, which may be plate hear exchangers or tube heat exchangers. Heat exchangers in the form of a coil placed outside the receivers are also possible.

Further, mixing points (190,195,290,295,390,395) on same refrigerant lines can be placed independently from each other and at various positions.

The invention claimed is:

1. A refrigeration system primarily using CO2 as refrigerant, which refrigeration system comprises at least one first compressor, which compressor comprises a pressure outlet tube connected to at least one heat rejecting heat exchanger, which heat rejecting heat exchanger is connected to one first pressure reduction device and by tubing further connected to at least one receiver, which receiver comprises at least one first liquid outlet, which outlet is connected by tubing to one or more first pressure reduction devices, which first pressure reduction devices are connected to at least one first group of evaporators, which evaporators are connected by suction tubing to a suction side of the compressor, which receiver comprises at least one second gas outlet, which second outlet is connected by tubing configured to direct gas refrigerant within an upper portion of the receiver to a second pressure reduction device, wherein the second pressure reduction device is configured to expand the gas refrigerant to a lower temperature state and is connected by tubing configured to direct the expanded gas refrigerant from the second pressure reduction device to a first heat exchanging device, which first heat exchanging device is integrated in the upper portion of the receiver and transfers heat from the gas refrigerant within the upper portion of the receiver to the expanded gas refrigerant in the first heat exchanging device heating the expanded gas refrigerant in the first heat exchanging device and cooling the gas refrigerant within the upper portion of the receiver, which heated expanded gas refrigerant in the first heat exchanging device is directly connected to the suction side of the compressor, and which cooled gas refrigerant within the upper portion of the receiver absorbs heat from a liquid refrigerant in a lower portion of the receiver.

2. The refrigeration system according to claim 1, wherein the second pressure reduction device is connected by tubing and combined with suction gas into a combined line, which combined line is connected to an inlet to the first heat exchanging device, which first heat exchanging device is by tubing connected to the suction side of the compressor.

3. The refrigeration system according to claim 1, wherein the suction gas is connected by tubing from the suction tubing to a second heat exchanging device, which second heat exchanging device is integrated into the receiver, which second heat exchanging device is connected by tubing to the suction side of the compressor.

4. The refrigeration system according to claim 1, wherein the refrigeration system comprises a second group of evaporators, which second evaporators are connected by tubing to the receiver outlet towards pressure reduction devices, which second evaporators are connected by tubing to the suction side of one or more second compressors, which second compressors have a pressure outlet, which pressure outlet is by tubing connected to the suction line to the first compressors.

5. The refrigeration system according to claim 1, wherein the refrigeration system comprises a second group of evaporators, which second evaporators are connected by tubing to the receiver outlet towards pressure reduction devices, which second evaporators are connected by tubing to a third heat exchanging device, which third heat exchanging device is integrated in the receiver, from which third heat exchanging device tubing connects to the suction side of one or more second compressors, which second compressors have a pressure outlet, which pressure outlet is by tubing connected through a mixing point to the suction line to the first compressors.

6. The refrigeration system according to claim 1, wherein the refrigeration system comprises a second group of evaporators, which second evaporators are connected by tubing to the receiver outlet towards pressure reduction devices which second evaporators are connected by tubing to a third heat exchanging device, which third heat exchanging device is integrated in the receiver, from which third heat exchanging device tubing connects to the suction side of one or more second compressors, which second compressors have a pressure outlet, which pressure outlet is by tubing connected to a mixing point, at which mixing point the gas is mixed with the line coming from the second pressure reduction device, which mixed gas is by tubing led into a heat exchanging device, which heat exchanging device is by tubing connected to a second mixing point, by which mixing point the gas is mixed with the suction gas in a line from the first evaporators, which second mixing point is connected to the suction side of the first compressor or first compressor group.

7. The refrigeration system according to claim 1, wherein the refrigeration system comprises a second group of evaporators, which second evaporators are connected by tubing to the receiver outlet towards pressure reduction devices, which second evaporators are connected by tubing to a third heat exchanging device, which third heat exchanging device is integrated in the receiver, from which third heat exchanging device tubing connects to the suction side of one or more second compressors, which second compressors have a pressure outlet, which pressure outlet is by tubing connected to a mixing point, at which mixing point the gas is mixed with the suction gas in line, which mixed gas is by tubing connected to a second mixing point, at which second mixing point the gas is mixed with the gas in line coming from the second pressure reduction device, which mixed gas is by tubing led into a heat exchanging device, which heat exchanging device is by tubing connected to the suction side of the first compressor or first compressor group.

* * * * *